United States Patent [19]

Drieu

[11] 4,287,455

[45] Sep. 1, 1981

[54] POWER SAVING CIRCUIT FOR GASEOUS DISCHARGE LAMPS

[75] Inventor: Maurice L. Drieu, Toronto, Canada

[73] Assignee: Erin Engineering (Ontario) Ltd., Mississauga, Canada

[21] Appl. No.: 105,001

[22] Filed: Dec. 18, 1979

[51] Int. Cl.[3] ..... H05B 41/36

[52] U.S. Cl. ..... 315/199; 315/158; 315/194; 315/291; 315/DIG. 4

[58] Field of Search ..... 315/194, 199, 291, DIG. 4, 315/DIG. 5, DIG. 7, 158; 307/311, 252 N, 252 Q; 250/551

[56] References Cited

U.S. PATENT DOCUMENTS

| | | | |
|---|---|---|---|
| 3,355,600 | 11/1967 | Mapham | 250/551 X |
| 3,845,350 | 10/1974 | Luursema et al. | 315/291 |
| 3,863,102 | 1/1975 | Herzog | 315/DIG. 4 |
| 3,878,431 | 4/1975 | Petrina | 315/199 X |
| 3,935,505 | 1/1976 | Spiteri | 315/194 |
| 4,197,485 | 4/1980 | Nuver | 315/291 |
| 4,217,616 | 8/1980 | Jessup | 307/311 X |

*Primary Examiner*—Eugene La Roche

[57] ABSTRACT

A power saving circuit for a gaseous discharge lamp includes a power circuit and a control circuit. The power circuit is connectable to an AC power supply and to at least one lamp and has a bilateral current conducting power switch with control electrode means. The control circuit has a control switch with control electrode means, and timing means operable to apply a signal to the control electrode means of the control switch to render the control switch conducting at a predetermined time during each half cycle of the AC power supply, the control switch conducting current until zero crossover at the end of each half cycle. Opto-coupler means are associated with the control switch on the one hand and with the control electrode means of the power switch on the other hand to cause actuation of the control electrode means of the power switch and subsequent current conduction by the power switch when the control switch is conducting. The control electrode means of the power switch is connected through the opto-coupler means to the power circuit to cause, while the opto-coupler means is actuated by current conduction through the control switch, adequate power switch actuating current to flow therethrough when the power switch is not conducting and substantially reduced or no current to flow therethrough when the power switch is conducting.

14 Claims, 4 Drawing Figures

POWER SAVING CIRCUIT FOR GASEOUS DISCHARGE LAMPS

Figure 1:
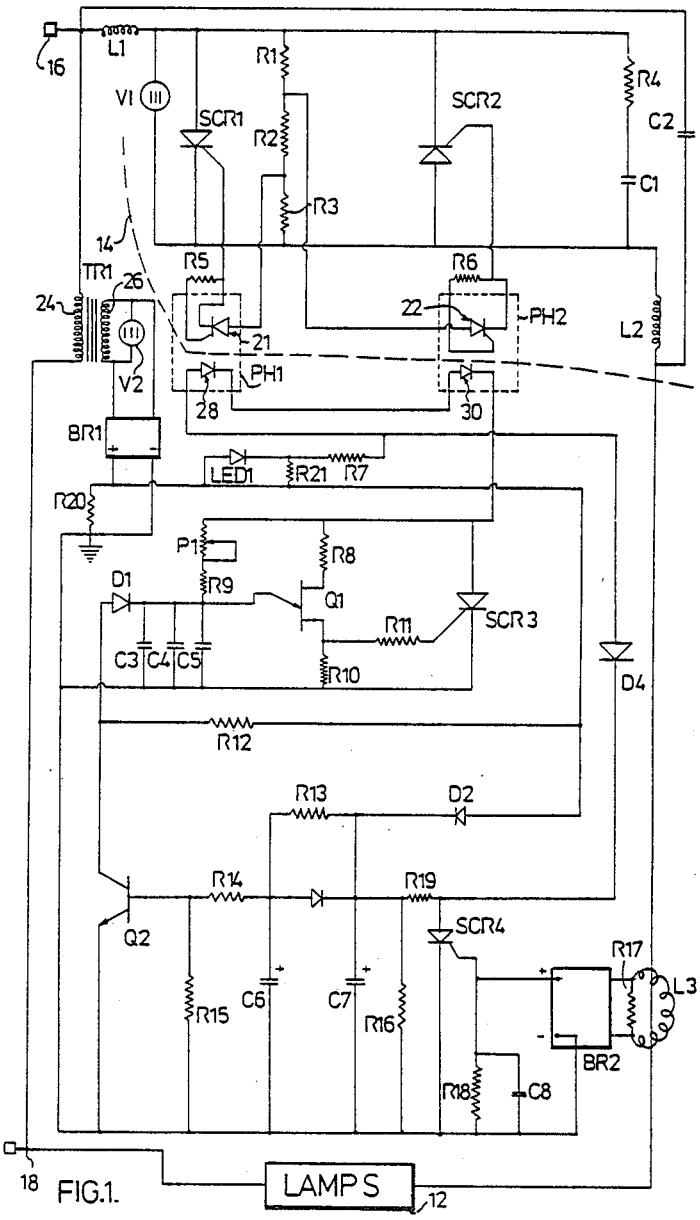

This invention relates to a power saving circuit for gaseous discharge lamps, for example fluorescent tubes.

It is known to control the AC power supply to a gaseous discharge lamp in such a manner that power is supplied to the lamp only during an adjustable predetermined portion of the time of each half cycle of the AC power supply.

In known circuits for this purpose, a power switch is caused to become conducting from a predetermined time in each half cycle to the end of the half cycle by applying a control signal to the power switch. However, a problem associated with such known circuits is caused by the necessity of supplying a control signal which is sufficient to cause conduction by the power switch for the relevant part of the half cycle and which on the other hand does not damage the power switch.

It is therefore an object of the invention to provide an improved power saving circuit for gaseous discharge lamps which overcomes this disadvantage.

According to the present invention, a power saving circuit for a gaseous discharge lamp comprises a power circuit connectable to an AC power supply and to at least one lamp, said power circuit including a bilateral current conducting power switch having control electrode means, a control circuit including a control switch having control electrode means, and timing means operable to apply a signal to said control electrode means of said control switch to render said control switch conducting at a predetermined time during each half cycle of the AC power supply, said control switch conducting current until zero crossover at the end of each half cycle, opto-coupler means associated with the control switch on the one hand and with the control electrode means of the power switch on the other hand to cause actuation of the control electrode means of the power switch and subsequent current conduction by the power switch when the control switch is conducting, said control electrode means of said power switch being connected through the opto-coupler means to the power circuit to cause, while the opto-coupler means is actuated by current conduction through the control switch, adequate power switch actuating current to flow therethrough when the power switch is not conducting and substantially reduced or no current to flow therethrough when the power switch is conducting.

Thus, the control electrode means of the power switch may be caused to conduct an adequate power switch actuating current to initiate current induction by the power switch and, since the actuating current is substantially reduced or brought to zero when the power switch is conducting, the likelihood of damage to the power switch by the actuating current is minimized.

The power switch may comprise a pair of thyristors connected in parallel and in opposite senses and across which voltage falls substantially when conducting current.

First, second and third resistors may be connected in series across the thyristors, with the control electrode of the first thyristor being connected through the opto-coupler means to the junction of the first and second resistors, and the control electrode of the other thyristor being connected through the opto-coupler means to the junction of the second and third resistors. In this way, an adequate gate current can be supplied to the thyristors of the power switch to cause conduction thereby, with the gate current reducing substantially to zero when its thyristor is conducting.

Alternatively, first and second resistors may be connected in series across the thyristors, with the control electrode of each thyristor being connected through the opto-coupler means to the junction of the first and second resistors. In a further alternative, the control electrode of one thyristor may be connected through the opto-coupler means and a first resistor to the anode of the first thyristor, with the control electrode of the other thyristor being connected through the opto-coupler means and a second resistor to the anode of the second thyristor.

The timing means and the control switch may be connected through the opto-coupler means and a full-wave rectifier to the secondary of a transformer whose primary is connectable to the AC power supply. The control switch may include a thyristor and the timing means may include a unijunction transistor operable to supply a gate pulse to the thyristor at the predetermined time during each half cycle of the AC power supply.

The power saving circuit may also include means for overriding the timing means for a predetermined time after switch-on of the circuit, the overriding means causing the control switch to conduct during each half cycle of the AC power supply at an earlier time than the predetermined time. The overriding means may include an initially non-conducting transistor and a capacitor which charges after switch-on to render the transistor conducting, such that conduction by the transistor deactivates the overriding means after the said predetermined time, and means causing the capacitor to discharge when the circuit is switched off. The overriding means may include a further capacitor and associated resistor which effects rapid discharge of the first mentioned capacitor when the circuit is switched off.

The power saving circuit may further include overload responsive means responsive to an abnormally high current from the power circuit to the lamp to de-activate the opto-coupler means within the half cycle of the AC power supply and thereby prevent subsequent actuation of the power switch. The overload responsive means may comprise a thyristor rendered conducting by the normally high current to remove an actuating signal from the control switch to the opto-coupler means. A light emitting diode may be connected to visually indicate current flow to the opto-coupling means and to the thyristor of the overload responsive means.

The power saving circuit may also include a transformer with a primary connected to receive AC power with the same phase as the power circuit and secondaries in the filament circuits of the lamp to maintain the lamp in operation when the timing means of the control circuit is adjusted to effect substantial power saving.

Figure 2:
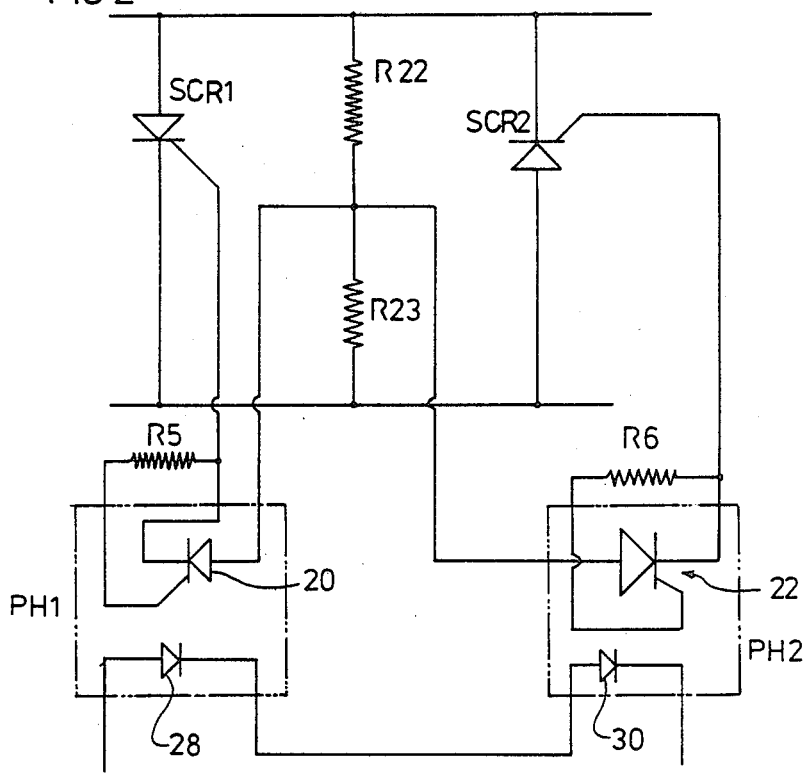
Figure 3:
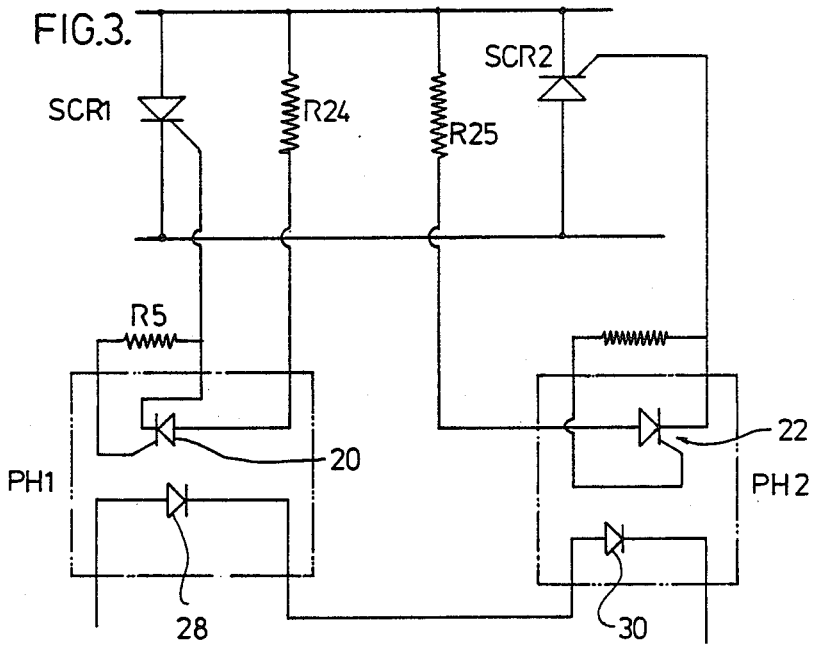
Figure 4:
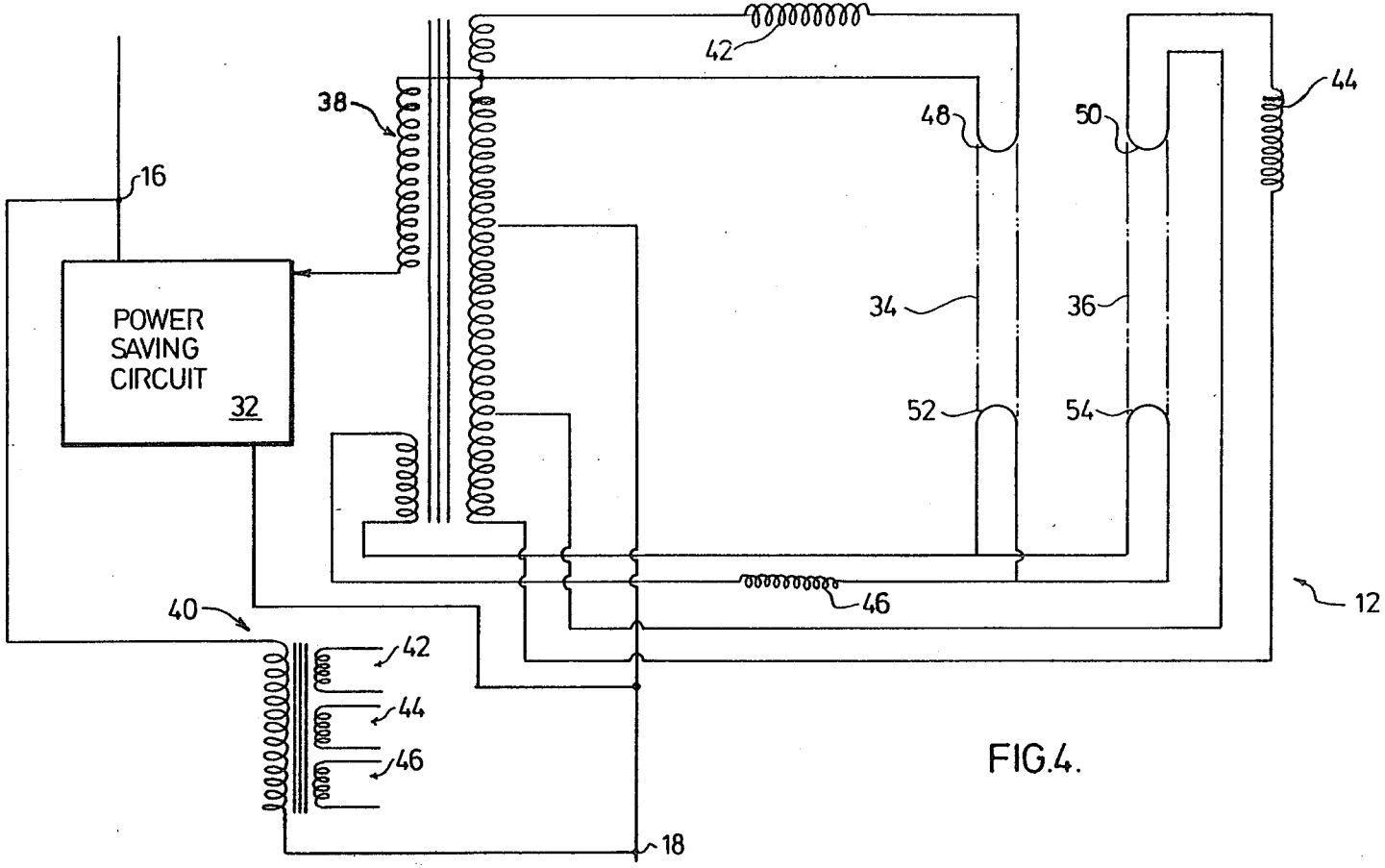

Embodiments of the invention will now be described, by way of example, with reference to the accompanying drawings, of which:

FIG. 1 shows a circuit diagram of a power saving circuit for one or more fluorescent lamps, FIG. 2 shows an alternative circuit for the control electrodes of the power switch, FIG. 3 shows another alternative circuit therefor, and FIG. 4 shows a modified power saving circuit to enable the lamps to be substantially dimmed.

Referring first to FIG. 1, a power saving circuit for a rapid start fluorescent lamp assembly 12 incudes a power circuit and a control circuit, the power circuit being that part of the circuit shown in the drawing appearing above the dotted line 14, and the control circuit being the part of the circuit shown in the drawing below the dotted line 14. The lamp assembly 12 may include a series of separate fluorescent lamp fixtures with each lamp fixture including a conventional ballast circuit.

The power circuit and the lamp assembly 12 are connected in series between two terminals 16, 18 of an AC power supply. The power circuit includes two power switches, namely silicon controlled rectifiers SCR1 and SCR2, connected in parallel with one another in opposite senses and through a first inductor L1 and AC terminal 16 and through a second inductor L2 to AC terminal 18, with a capacitor C2 being connected across inductors L1 and L2.

Three resistors R1, R2 and R3 are connected across SCR1 and SCR2. The junction of resistors R2 and R3 is connected to the anode of a light sensitive silicon controlled rectifier 20 of an opto-coupler PH1. The cathode of the silicon controlled rectifier 20 is connected to the gate of power switch SCR1 and is also connected through resistor R5 to its own gate. Similarly, the junction of resistors R1 and R2 is connected to the anode of a light sensitive silicon controlled rectifier 22 in another opto-coupler PH2. The cathode of the silicon controlled rectifier 22 is connected to the gate of power switch SCR2, and is also connected through resistor R6 to its own gate.

A transient limiter V1 is also connected across power switches SCR1 and SCR2, and a resistor R4 and capacitor C1 are likewise connected as a snubbing dv/dt circuit.

The control circuit includes a step-down transformer TR1 with a primary 24 connected between AC terminals 16 and 18, and a 12-volt secondary 26 connected to full wave rectifier bridge BR1, with a transient limiter V2 being connected across the secondary 26. The positive output terminal of bridge BR1 is connected through a light emitting diode LED1 and resistor R7 to the anode of a light emitting diode 28 in opto-coupler PH1, and the cathode of the light emitting diode 28 in opto-coupler PH1 is connected to the anode of a light emitting diode 30 in opto-coupler PH2. The cathode of light emitting diode 30 is connected to the anode of a control switch, namely silicon controlled rectifier SCR3, whose cathode is connected to ground. The negative terminal of bridge rectifier BR1 is connected to ground, with a resistor R20 being connected across the positive and negative output terminals of bridge BR1. Also, a resistor R21 is connected between the junction of diode LED1 and resistor R7 on the one hand and the positive output terminal of bridge BR1 on the other hand.

A pulse generating unijunction transistor Q1 is connected between resistors R8 and R10 across the control switch SCR3. The gate of control switch SCR3 is connected through resistor R11 to the base of pulse generator Q1 which is connected to resistor R10. A resistor R9 and potentiometer P1 are connected between the emitter of pulse generator Q1 and the anode of control switch SCR3, and capacitors C3, C4 and C5 are connected between the emitter of pulse generator Q1 and ground.

As will be described in more detail later, the emitter circuit of pulse generator Q1 is additionally supplied with current during start-up from the positive terminal of bridge BR1 through resistor R12 and diode D1. Such start-up current is terminated after a predetermined time by operation of a transistor Q2 whose collector is connected between resistor R12 and diode D1 and whose emitter is connected to ground. A capacitor C6 is charged from bridge rectifier BR1 through diode D2 and resistor R13, the positive side of capacitor C6 being connected through resistor R14 to the base of transistor Q2, and the negative side of capacitor C6 being connected to ground. A resistor R15 is connected between the base of transistor Q2 and ground.

The positive side of capacitor C6 is also connected through diode D3 to the positive side of a further capacitor C7, whose negative side is connected to ground. The positive side of capacitor C7 is further connected to the cathode of diode D2, and a resistor R16 is connected across capacitor C7.

The control circuit also includes an overload responsive circuit having an overload switch, namely silicon controlled rectifier SCR4, whose anode is connected through diode D4 to the negative end of the resistor R7 and whose cathode is connected to ground. The positive side of capacitor C7 is connected to the anode of overload switch SCR4 through resistor R19. An inductor L3 surrounding the line between the inductor L3 and lamp assembly 12 is connected to a bridge rectifier BR2, with a resistor R17 being connected across the inductor L3. The positive DC terminal of rectifier BR2 is connected to the gate of overload switch SCR4. Resistor R18 and capacitor C18 are connected in parallel between the gate of overload switch SCR4 and ground.

In operation of the circuit described above, assuming that the lamp assembly 12 is already in operation, the respective power switch SCR1 or SCR2 is caused to conduct during a part of each half cycle of the AC power supply by operation of the control circuit, as will now be described.

The increasing voltage of each AC half cycle produces a lower increasing voltage in the secondary of transformer TR1 to cause capacitors C3, C4 and C5 to charge through potentiometer P1 and resistor R9. Depending upon the setting of potentiometer P1, unijunction transistor Q1 fires a short pulse when the voltage across capacitors C3, C4 and C5 reaches the required value, with the result that gate current is supplied to control switch SCR3. Control switch SCR3 then conducts so that current flows through light emitting diode LED1, resistor R7 and opto-couplers PH1 and PH2. Gate current is consequently supplied to power switch SCR1 and SCR2, one of which then conducts, depending on the polarity of the AC pulse. Resistors R1, R2 and R3 function to provide an optimum large trigger current to the gate of the relevant power switch SCR1 or SCR2 thereby ensuring fast turn-on.

As soon as the power switch SCR1 or SCR2 conducts, the voltage across it falls to a very low value, with the result that the gate current is correspondingly reduced. In fact, the voltage may be so low that the silicon control rectifier 20, 22 in the opto-coupler PH1 or PH2 does not conduct, with the result that the gate current is zero.

Control switch SCR3 remains conducting until the end of the half cycle, with consequent current flow through the diodes 28 and 30 in the opto-couplers PH1 and PH2. Thus, if the power switch SCR1 or SCR2 should cease conducting, because for example of some ringing or spiking in the AC power supply, voltage across the power switch will be restored, with consequent restoration of gate current to cause the power switch SCR1 or SCR2 to resume conduction.

Thus, the relevant power switch SCR1 or SCR2 is reliably turned on by a high gate current which is removed when the power switch is conducting, thereby reducing the likelihood of damage thereto.

The transformer TR1 and bridge rectifier BR1 supply a unilateral half wave DC voltage to the unijunction transistor Q2 without any regulation or clipping of the wave, therefore allowing instantaneous mains voltage variations to increase through resistor R8 to unijunction transistor Q2 and to potentiometer P1. Therefore, the firing time of unijunction transistor Q2 remains unchanged with power line variations, since it is the ratio between the voltage at these two points and not their absolute value which determines the firing time. Thus, the circuit provides a correcting factor in the power delivered to the load when power line variations occur.

Because of the opto-couplers PH1 and PH2, the control circuit is electrically isolated from the power circuit, and is not affected by changes of load or nature of load. It will be noted that control switch SCR3 "sees" only a resistive load and is turned on reliably by the short pulse from unijunction transistor Q1.

At the end of the half cycle, as the voltage crosses over, control switch SCR3 is switched off with resultant de-activation of opto-couplers PH1 and PH2, and the relevant power switch SCR1 and SCR2 ceases conducting. During the next half cycle, the other power switch SCR1 or SCR2 fires when control switch SCR3 is switched on. Capacitors C3, C4 and C5 are discharged by firing of transistor Q1, and hence are prepared for recharging at the start of each half cycle.

Power saving is therefore effected since the lamp assembly 12 is only operating for a part of each half cycle, the turn-on point in each half cycle being determined by the setting of potentiometer P1. In this way, the power saving circuit can be varied to operate the lamp assembly 12 with a power consumption from about 40% to about 95% of full power.

As previously mentioned, the control circuit includes a starting circuit, and this starting circuit in effect overrides the timing provided by potentiometer P1 for a predetermined time, for example about 10 seconds, sufficient to ensure the firing of all fluorescent tubes in the lamp assembly 12.

When the AC power supply is initially switched on, transistor Q2 has no drive, so that at the start of each half cycle capacitors C3, C4 and C5 are charged through resistor R12 and diode D1 as well as through potentiometer P1 and resistor R9, with the result that control switch Q1 fires early in the half cycle. After about 10 seconds, for example, capacitor C6 becomes sufficiently charged through diode D2 and resistor R13 to actuate transistor Q2 to cause diode D1 to become reversed biased, so that charging current through resistor R12 is removed.

When the power supply is switched off, capacitor D7 discharges quickly through resistor R16, and this causes fast discharge of capacitor C6 through diode D3 so that the starting circuit is reset for operation next time the power is switched on.

If, because of a fault, an abnormally high current appears in the load line to the lamp 12, the voltage induced in inductor L3 causes gate current to be supplied to overload switch SCR4 which conducts to short resistor R7 to ground and, within the half cycle, de-activate opto-couplers PH1 and PH2. Neither power switch SCR1 nor SCR2 can therefore conduct during subsequent half cycles of the AC power supply. Switch SCR4 remains in the conducting condition due to voltage across capacitor C7 acting through resistor R19 until the power supply is switched off. Operation of switch SCR4 causes light emitting diode D1 to have a greater brilliance and therefore indicates that the power circuit has been switched off by switch SCR4.

While the power saving circuit is functioning normally, light emitting diode LED1 will have a smaller brilliance which varies according to the power saving setting of the potentiometer P1.

Resistor R20 associated with bridge BR1 functions to reduce the voltage at the positive output terminal to zero at the end of a half cycle. Resistor R21 achieves a similar effect at the cathode of diode LED1.

Suitable components for the circuit described above are as follows:

SCR1—CS 23 10GO3
SCR2—CS 23 10GO3
SCR3—2n 5061
SCR4—2n 5061

Resistors
R1—1K
R2—1.5K
R3—1K
R4—100 ohms
R5—27K
R6—27K
R7—360 ohms
R8—330 ohms
R9—10K
R10—82 ohms
R11—820 ohms
R12—22K
R13—220K
R14—200K
R15—47K
R16—10K
R17—27 ohms
R18—1K
R19—2.2K
R20—560 ohms
R21—100 ohms Capacitors
C1—0.1 μF
C2—0.1 μF
C3—0.1 μF
C4—0.01 μF
C5—0.001 μF
C6—40 μF
C7—2.2 μF
C8—0.1 μF Inductors
L1—2 turns
L2—2 turns
L3—750 turns Transformers
TR1—PR1 347 V SEC 12 V, 50 mA Bridge Rectifiers
BR1—Varo VM 08
BR2—Varo VM 08

Transistors
Q1—mu 4894
Q2—2 N 2924

Potentiometer
P1—50K Linear

Opto-couplers

PH1—H 11 C 6
PH2—H 11 C 6
Light emitting diode
LED1—NSL 5026
Limiters
V1—V 420 LB 20 A
V2—V 22 Z A1

Instead of the arrangements with three resistors R1, R2 and R3 as described above, the silicon controlled rectifiers 20, 22 of the opto-couplers PH1 and PH2 may be connected to the junction of two resistors R22, R23 connected in series across the power switches SCR1 and SCR2. as shown in FIG. 2.

As another alternative, the anode of the silicon control rectifier 20 of opto-coupler PH1 may be connected through resistor 24 to the anode of power switch SCR1, and the anode of the silicon control rectifier 22 of opto-coupler PH2 may be connected through resistor R25 to the anode of the power switch SCR2, as shown in FIG. 3.

As mentioned earlier, the power saving circuit shown in FIG. 1 enables power consumption to be reduced to about 40% by adjustment of the potentiometer P1. To enable the potentiometer P1 to be adjusted to reduce the power still further, a transformer may be provided to increase the voltage in the filament circuits of the lamp assembly 12.

FIG. 4 shows the power saving circuit of FIG. 1 in block form, as indicated by the numeral 32, with the lamp assembly 12 being shown in some detail. The lamp assembly 12 includes two fluorescent tubes 34, 36 connected to a conventional ballast transformer 38. As will be readily apparent to a person skilled in the art, other conventional components of the ballast circuit have been omitted for the sake of clarity.

In accordance with this embodiment of the invention, the primary of a transformer 40 is connected to the same AC terminal 16 as the power saving circuit and to the neutral terminal 18. The transformer 40 has three secondaries 42, 44, 46. The secondary 42 is connected in the circuit of a filament 48 at one end of the fluorescent tube 34, the secondary 44 is connected in the circuit of a filament 50 at one end of fluorescent tube 36, and the secondary 46 is connected in the common circuit of the filaments 52, 54 at the other ends of the fluorescent tubes 34, 36.

The secondaries 42, 44, 46 are such as to cause the supply of adequate heating current to the respective filaments, even though the potentiometer P1 in the power saving circuit is adjusted to substantially dim the fluorescent tubes 34, 36. Since the primary of the transformer 40 is connected to the same live AC power supply line 16 as the power saving circuit, the secondaries 42, 44, 46 are in the correct phase relationship with the other components of the ballast circuit.

Other embodiments of the invention will be readily apparent to a person skilled in the art, the scope of the invention being defined in the appended claims.

What I claim as new and desire to protect by Letters Patent of the United States is:

1. A power saving circuit for a gaseous discharge lamp comprising, a power circuit connectable to an AC power supply and to at least one lamp, said power circuit including a bilateral current conducting power switch having control electrode means, a control circuit including a control switch having control electrode means, and timing means operable to apply a signal to said control electrode means of said control switch to render said control switch conducting at a predetermined time during each half cycle of the AC power supply, said control switch conducting current until zero crossover at the end of each half cycle, opto-coupler means associated with the control switch on the one hand and with the control electrode means of the power switch on the other hand to cause actuation of the control electrode means of the power switch and subsequent current conduction by the power switch when the control switch is conducting, said control electrode means of said power switch being connected through the opto-coupler means to the power circuit to cause, while the opto-coupler means is actuated by current conduction through the control switch, adequate power switch actuating current to flow therethrough when the power switch is not conducting and substantially reduced or no current to flow therethrough when the power switch is conducting.

2. A power saving circuit according to claim 1 wherein said power switch comprises a pair of thyristors connected in parallel and in opposite senses and across which voltage falls substantially when conducting current.

3. A power saving circuit according to claim 2 wherein first, second and third resistors are connected in series across said thyristors, the control electrode of the first thyristor is connected through the opto-coupler means to the junction of the first and second resistors, and the control electrode of the second thyristor is connected through the opto-coupler means to the junction of the second and third resistors.

4. A power saving circuit according to claim 2 wherein first and second resistors are connected in series across said thyristors, and the control electrode of each thyristor is connected through the opto-coupler means to the junction of the first and second resistors.

5. A power saving circuit according to claim 2 wherein the control electrode of one thyristor is connected through the opto-coupler means and a first resistor to the anode of the first thyristor, and the control electrode of the other thyristor is connected through the opto-coupler means and a second resistor to the anode of the second thyristor.

6. A power saving circuit according to claim 1 wherein the timing means and the control switch are connected through the opto-coupler means and a full-wave rectifier to the secondary of a transformer whose primary is connectable to the AC power supply.

7. A power saving circuit according to claim 1 wherein the control switch comprises a thyristor, and the timing means includes a unijunction transistor operable to supply a gate pulse to the thyristor at said predetermined time during one half cycle of the AC power supply.

8. A power saving circuit according to claim 1 also including means for overriding said timing means for a predetermined time after switch-on of the power saving circuit, said overriding means causing said control switch to conduct during each half cycle of the AC power supply at an earlier time than said predetermined time.

9. A power saving circuit according to claim 8 wherein the overriding means includes an initially non-conducting transistor and a capacitor which charges upon start-up of the power saving circuit to render the transistor conducting after said predetermined time after circuit start-up, with conduction of said transistor de-activating said overriding means, and means causing the capacitor to discharge when said circuit is switched off.

10. A power saving circuit according to claim 9 wherein said discharge means includes a further capacitor and associated resistor which causes expedited discharge of the first capacitor.

11. A power saving circuit according to claim 1 also including overload responsive means responsive to an abnormally high current from the power circuit to the lamp to de-activate the opto-coupler means within the half cycle of said AC power supply and thereby prevent subsequent activation of said power switch.

12. A power saving circuit according to claim 11 wherein the overload responsive means comprises a thyristor rendered conducting by said abnormally high current to remove an actuating signal to said opto-coupler means from said control switch.

13. A power saving circuit according to claim 12 including a light emitting diode connected to visually indicate current conduction through said control switch and current conduction through said thyristor of said overload responsive means.

14. A power saving circuit according to claim 1 also including a transformer having a primary connected to receive AC power with the same phase as the power circuit and secondaries in the filament circuits of the lamp to maintain the lamp in operation when said timing means of said control circuit is adjusted to effect substantial power saving.

* * * * *